US011559147B2

(12) United States Patent
Joardar

(10) Patent No.: US 11,559,147 B2
(45) Date of Patent: Jan. 24, 2023

(54) REFRIGERATED DISPLAY CABINET UTILIZING A RADIAL CROSS FLOW FAN

(71) Applicant: Carrier Corporation, Palm Beach Gardens, FL (US)

(72) Inventor: Arindom Joardar, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 482 days.

(21) Appl. No.: 16/405,856

(22) Filed: May 7, 2019

(65) Prior Publication Data

US 2020/0352356 A1 Nov. 12, 2020

(51) Int. Cl.
*F25D 17/08* (2006.01)
*A47F 3/04* (2006.01)

(52) U.S. Cl.
CPC ..... *A47F 3/0447* (2013.01); *A47F 3/0478* (2013.01); *A47F 3/0491* (2013.01); *F25D 17/08* (2013.01); *A47F 2003/046* (2013.01); *F25B 2400/22* (2013.01)

(58) Field of Classification Search
CPC .... A47F 3/0447; A47F 3/0478; A47F 3/0491; A47F 2003/046; F25B 2400/22; F25D 17/08; F24F 2003/1446
See application file for complete search history.

(56) References Cited

U.S. PATENT DOCUMENTS 2,494,481 A 1/1950 MacMaster et al.
2,657,546 A 11/1953 Smith
2,672,735 A 3/1954 Fusselman
2,750,758 A 6/1956 Hoye et al.
2,838,809 A 6/1958 Zeolla et al.
3,091,942 A 6/1963 Dickson et al.
3,103,796 A 9/1963 Dickson et al.
3,111,817 A 11/1963 Solley, Jr.
(Continued)

FOREIGN PATENT DOCUMENTS

BR 102015028925 5/2017
CN 86103298 11/1986
(Continued)

OTHER PUBLICATIONS

US 8,764,130 B1, 07/2014, Pack et al. (withdrawn)
European Search Report for Application No. 20173028.0 dated Sep. 9, 2020.

*Primary Examiner* — David J Teitelbaum
(74) *Attorney, Agent, or Firm* — Carlson, Gaskey & Olds, P.C.

(57) ABSTRACT

A refrigerated display case includes a housing surrounding multiple shelves. An air distribution gap is defined behind the shelves. An air return passage is defined below the shelves. A radial cross-flow fan is disposed in a fan region of the air return passage. The radial cross-flow fan includes an output connected to the air distribution gap. A primary cooling microchannel heat exchanger is disposed in the fan region downstream of the radial cross-flow fan such that air output from the radial cross-flow fan to the air distribution gap passes through the primary cooling microchannel heat exchanger. A pre-cooler microchannel heat exchanger is disposed upstream of the primary cooling microchannel heat exchanger.

19 Claims, 3 Drawing Sheets

(56) References Cited

U.S. PATENT DOCUMENTS 3,186,185 A 6/1965 Bently et al.
3,289,432 A * 12/1966 Brennan ..... A47F 3/0447 62/256
3,369,375 A * 2/1968 Gerweck ..... A47F 3/0447 62/256
3,444,698 A 5/1969 Lorenz
3,462,966 A 8/1969 Reid et al.
3,531,945 A 10/1970 Brennan
3,577,744 A 5/1971 Mercer
3,848,426 A 11/1974 Whitney
3,893,307 A 7/1975 Jacobs
3,898,864 A 8/1975 Steelman
4,004,370 A 1/1977 Heaney
4,009,586 A 3/1977 Skvarenina
4,035,608 A 7/1977 Stromquist et al.
4,117,698 A 10/1978 Vogel
4,127,765 A 11/1978 Heaney
4,150,550 A 4/1979 Mercer, Sr.
4,197,718 A 4/1980 Abraham et al.
4,245,482 A 1/1981 Abraham
4,248,015 A 2/1981 Stromquist et al.
4,265,090 A 5/1981 Abraham
4,272,969 A 6/1981 Schwitzgebel
4,302,946 A 12/1981 Ibrahim
4,312,190 A 1/1982 Ibrahim et al.
4,319,463 A 3/1982 Ljung
4,341,082 A 7/1982 Ibrahim
4,347,710 A 9/1982 Ibrahim
4,375,155 A 3/1983 Rosanio et al.
4,389,852 A 6/1983 Abraham
4,389,856 A 6/1983 Ibrahim
4,414,822 A 11/1983 Ibrahim
4,474,017 A 10/1984 Prada
4,592,209 A 6/1986 Casanova et al.
4,741,172 A 5/1988 Aoki
4,750,335 A 6/1988 Wallace et al.
4,782,666 A 11/1988 Costan
4,855,567 A 8/1989 Mueller
4,879,881 A 11/1989 Madigan
4,938,034 A * 7/1990 Rosanio ..... A47F 3/0447 62/256
4,949,554 A 8/1990 Branz et al.
4,998,382 A 3/1991 Kostos et al.
5,009,080 A 4/1991 Naganuma et al.
5,031,413 A 7/1991 Tsuihiji et al.
5,097,642 A 3/1992 Richardson et al.
5,203,175 A 4/1993 Farrey et al.
5,329,736 A 7/1994 Sodervall
5,357,767 A * 10/1994 Roberts ..... A47F 3/0447 454/193
5,606,863 A 3/1997 Kicklighter et al.
5,704,221 A 1/1998 Lego
5,727,393 A 3/1998 Mahmoudzadeh
5,743,098 A 4/1998 Behr
5,778,689 A 7/1998 Beatenbough
5,867,994 A 2/1999 Kopko
5,931,013 A 8/1999 Wickman
6,144,017 A 11/2000 Millett et al.
6,151,904 A 11/2000 Jin
6,185,958 B1 2/2001 Wightman
6,311,512 B1 11/2001 Fung et al.
6,435,630 B1 8/2002 Anin et al.
6,460,372 B1 10/2002 Fung et al.
6,547,346 B2 4/2003 Topper et al.
6,615,593 B2 9/2003 Thurman
6,718,778 B2 4/2004 Lawrence
6,912,864 B2 7/2005 Roche et al.
6,981,385 B2 1/2006 Arshansky et al.
7,003,920 B1 2/2006 Messere et al.
7,207,181 B2 4/2007 Murray et al.
7,275,376 B2 10/2007 Swofford et al.
7,340,907 B2 3/2008 Vogh, III
7,367,198 B2 5/2008 Behr
7,614,249 B2 11/2009 Hu
7,891,153 B2 2/2011 Cording
7,891,154 B2 2/2011 Cording
7,905,101 B2 3/2011 Sunderland et al.
7,997,094 B2 8/2011 Zangari et al.
8,057,615 B2 11/2011 Grussaute-Nghiem et al.
8,104,302 B2 1/2012 Hayase et al.
8,151,587 B2 4/2012 Chiang et al.
8,215,921 B2 7/2012 Coonrod
8,250,873 B2 8/2012 Yoon et al.
8,359,876 B2 1/2013 Esformes
8,534,006 B2 9/2013 Roche et al.
8,539,783 B1 9/2013 Bunch
8,613,161 B2 12/2013 Nicholson et al.
8,677,771 B2 3/2014 Li et al.
8,769,970 B2 7/2014 Fung et al.
8,776,443 B2 7/2014 Bienick
8,997,507 B2 4/2015 Boarman
9,046,294 B2 6/2015 Lee et al.
9,157,675 B2 10/2015 Howington et al.
9,217,600 B2 12/2015 Malisi
9,456,705 B2 10/2016 Zangari et al.
9,578,977 B2 2/2017 Smith
9,964,350 B2 5/2018 Rees et al.
10,039,390 B2 8/2018 Artwohl et al.
2001/0003248 A1 6/2001 Otto et al.
2001/0042384 A1* 11/2001 Chiang ..... F25B 41/043 62/246
2003/0172670 A1* 9/2003 Vormedal ..... F25D 23/023 62/407
2005/0076662 A1* 4/2005 Roche ..... A47F 3/0447 62/246
2005/0229614 A1 10/2005 Ansted
2006/0103269 A1 5/2006 Artwohl et al.
2007/0077399 A1 4/2007 Borowiec et al.
2007/0289323 A1 12/2007 Swofford et al.
2008/0104973 A1 5/2008 Hall et al.
2009/0205351 A1 8/2009 Fung
2010/0199686 A1 8/2010 Taras et al.
2010/0200150 A1 8/2010 Ougitani et al.
2010/0212343 A1 8/2010 Swofford et al.
2010/0300127 A1 12/2010 Gu et al.
2012/0067072 A1 3/2012 Malwitz et al.
2013/0098077 A1 4/2013 Bonet
2013/0213073 A1* 8/2013 Fritz ..... F28D 1/05383 62/255
2014/0069125 A1 3/2014 Chikkakalbalu et al.
2014/0260360 A1 9/2014 Rasch
2015/0285551 A1 10/2015 Aiken et al.
2016/0360900 A1 12/2016 Holst et al.
2017/0020305 A1 1/2017 Fischer
2017/0208966 A1 7/2017 Reichert

FOREIGN PATENT DOCUMENTS

CN 1050604 4/1991
CN 2223463 3/1996
CN 1311420 9/2001
CN 2583582 10/2003
CN 2583584 10/2003
CN 2583585 10/2003
CN 101093129 12/2007
CN 102297565 12/2011
CN 102379580 3/2012
CN 104654671 5/2015
CN 204478635 7/2015
CN 204923650 12/2015
CN 205037628 2/2016
CN 205448463 8/2016
CN 106595196 4/2017
CN 10693186 7/2017
CN 107101436 8/2017
CN 207186420 4/2018
CN 207455994 6/2018
CN 106545269 9/2018
DE 2934457 3/1981
EP 0527500 2/1993
EP 0717945 6/1996
EP 1029478 8/2000
EP 1203551 5/2002

(56) References Cited

FOREIGN PATENT DOCUMENTS

| | | |
|---|---|---|
| EP | 1414327 | 5/2004 |
| EP | 2310773 | 4/2011 |
| FR | 1282235 | 1/1962 |
| FR | 1386573 | 1/1965 |
| FR | 2443228 | 7/1980 |
| FR | 2488500 | 2/1982 |
| FR | 2525886 | 11/1983 |
| GB | 796626 | 6/1958 |
| GB | 2167846 | 6/1986 |
| GB | 2210683 | 6/1989 |
| IN | 2690DEL2010 | 11/2012 |
| JP | H10253229 | 9/1998 |
| JP | 2000018796 | 1/2000 |
| JP | 2004000372 | 1/2004 |
| KR | 1019990038394 | 6/1996 |
| WO | 0053062 | 9/2000 |
| WO | 2006087690 | 8/2006 |
| WO | 2015165512 | 11/2015 |
| WO | 2018034846 | 2/2018 |

* cited by examiner

REFRIGERATED DISPLAY CABINET UTILIZING A RADIAL CROSS FLOW FAN

TECHNICAL FIELD

The present disclosure relates generally to refrigerated display cabinets, and more specifically to a cabinet utilizing a radial cross-flow fan for driving the refrigerated air.

BACKGROUND

In practice, the grocery stores and supermarkets use refrigerated merchandisers of different types, which may be open or with doors, for displaying and presenting fresh food and beverages to the customers while maintaining a temperature of the products below a predefined threshold. In order to maintain the low temperature, cold air is circulated to the product display area of the cabinet by passing airflow over a heat exchanger surface of an evaporator. A cold refrigerant is pumped through the internal passages of the tubes which absorb the heat from the air via fins and tube surfaces and changes from a liquid phase to a vapor phase in the process. As a result the temperature of the air passing through the evaporator is lowered. One or more fans are typically included in the base of the refrigerated display cabinet and drive cold air through the heat exchanger and into the product display area of the merchandiser.

In addition to the increased operating costs and high first cost due required sizes of the heat exchangers, frost buildup and need for defrost cycles negatively impacts fan performance and energy efficiency of the merchandiser.

SUMMARY OF THE INVENTION

In one exemplary embodiment a refrigerated display case includes a housing surrounding a plurality of shelves, an air distribution gap defined behind the plurality of shelves, an air return passage defined below the plurality of shelves, a radial cross-flow fan disposed in a fan region of the air return passage, the radial cross-flow fan having an output connected to the air distribution gap, a primary cooling microchannel heat exchanger disposed in the fan region downstream of the radial cross-flow fan such that air output from the radial cross-flow fan to the air distribution gap passes through the primary cooling microchannel heat exchanger, and a pre-cooler microchannel heat exchanger disposed upstream of the primary cooling microchannel heat exchanger.

In another example of the above described refrigerated display case the pre-cooler microchannel heat exchanger is disposed downstream of the cross-flow fan.

In another example of any of the above described refrigerated display cases the pre-cooler microchannel heat exchanger connects the output of the radial cross-flow fan to the air distribution gap.

In another example of any of the above described refrigerated display cases the primary cooling microchannel heat exchanger is disposed immediately downstream of the pre-cooler microchannel heat exchanger.

In another example of any of the above described refrigerated display cases the pre-cooler microchannel heat exchanger is disposed upstream of the radial cross-flow fan.

In another example of any of the above described refrigerated display cases the pre-cooler microchannel heat exchanger includes a cooled air output connected to an input of the radial cross-flow fan.

In another example of any of the above described refrigerated display cases the pre-cooler microchannel heat exchanger has a first saturation temperature and the primary cooling microchannel heat exchanger has a second saturation cooling temperature, and where the second saturation temperature is lower than the first saturation temperature.

In another example of any of the above described refrigerated display cases the first saturation temperature is below a temperature required to extract moisture from the return air and above a minimum cooling temperature for the plurality of shelves.

In another example of any of the above described refrigerated display cases the second saturation temperature is above a frost temperature.

Another example of any of the above described refrigerated display cases further includes a top duct define above the plurality of shelves and connecting the air distribution gap to an air curtain fan and a third microchannel heat exchanger connected to the air curtain fan such that cooled air is provided to the air curtain fan.

In another example of any of the above described refrigerated display cases the fan region is at a downstream end of the air return passage.

An exemplary method of cooling shelves in a refrigerated display cabinet includes driving air through a cooling circuit using a radial cross-flow fan, passing the air through a primary microchannel heat exchanger, thereby cooling the air below a minimum cooling temperature of at least one shelf, and extracting moisture from the air using a pre-cooler microchannel heat exchanger prior to passing the air through the primary microchannel heat exchanger.

In another example of the above described method of cooling shelves in a refrigerated display cabinet the pre-cooler microchannel heat exchanger is downstream of the radial cross-flow fan and upstream of the primary microchannel heat exchanger.

In another example of any of the above described methods of cooling shelves in a refrigerated display cabinet the pre-cooler microchannel heat exchanger is upstream of the radial cross-flow fan.

Another example of any of the above described methods of cooling shelves in a refrigerated display cabinet further includes driving at least a portion of the air to create a downward flowing air curtain using an air curtain fan.

Another example of any of the above described methods of cooling shelves in a refrigerated display cabinet further includes cooling the at least the portion of the air immediately prior to the air curtain fan using a micro-channel heat exchanger.

Another example of any of the above described methods of cooling shelves in a refrigerated display cabinet further includes operating the primary microchannel heat exchanger at a saturation temperature below a frost point and operating the pre-cooler microchannel heat exchanger at a temperature above the frost point and below a condensation point.

Another example of any of the above described methods of cooling shelves in a refrigerated display cabinet further includes deactivating the pre-cooler microchannel heat exchanger in response to a controller determining a low load period.

Another example of any of the above described methods of cooling shelves in a refrigerated display cabinet further includes reactivating the pre-cooler microchannel heat exchanger in response to a controller detecting a door opening.

These and other features of the present invention can be best understood from the following specification and drawings, the following of which is a brief description.

DETAILED DESCRIPTION

Figure 1:
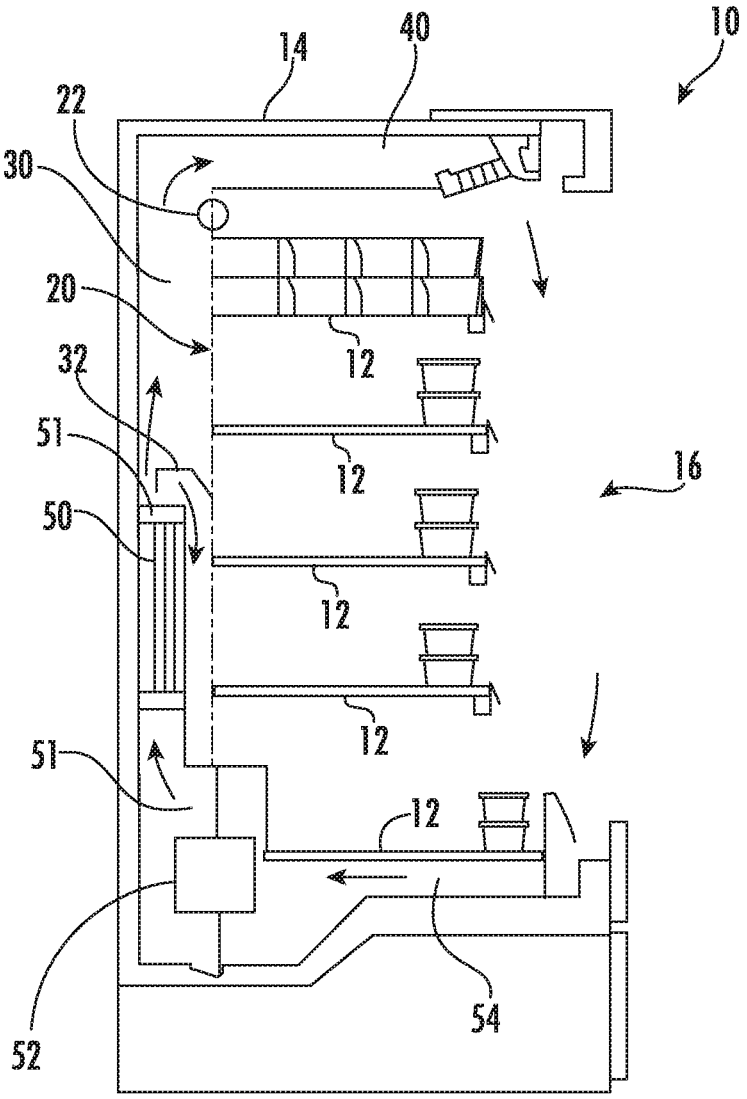
FIG. 1 PRIOR ART
FIG. 1 illustrates a prior art refrigerated display cabinet.

FIG. 1 schematically illustrates an exemplary prior art refrigerated display cabinet 10. The prior art cabinet 10 includes multiple shelves 12 contained within a cabinet housing 14. Each of the shelves 12 faces a front opening 16, and is supported at a rear end by a sheet metal distribution plate 20. The sheet metal distribution plate 20 defines a gap 30 in the rear of the cabinet 10, and a gap 40 at the top of the cabinet 10. As there is no obstruction between the gap 30 and the gap 40, the two gaps 30, 40 combine to define a single cooled air space. The distribution plate 20 includes multiple distribution holes 22 that allow cooled air to pass from the rear of the gap 30 into a corresponding shelf 12 region.

Also included within the gap 30 is a round-tube plate-fin heat exchanger 50 for cooling the air being provided to the shelves 12. A fan 52 is positioned immediately downstream of the heat exchanger 50 at an aft end of a return cavity 54 below the bottom most shelf 12. The fan 52 drives all of the air from the return cavity 54 to pass through the heat exchanger 50, thereby causing all of the air to be cooled. An aft end 51 of the heat exchanger 50 expels cooled air into the gap 30. A portion of the air flows upward through the gap 30 to the top gap 40 and the top shelves 12. A redirection feature 32 alters a flow direction of another portion of the cooled air by 180 degrees such that the redirected cooled air is provided to the lower shelves 12.

The size of the gap 30 is dictated by the size of the heat exchanger 50, and the space between the heat exchanger 50 and the distribution plate 20 required to allow sufficient air to be provided to each shelf 12. Further, as all of the air is cooled by the single heat exchanger 50, the heat exchanger 50 must be sufficiently sized to cool all of the air to a temperature that remains below the required temperature until it reaches the farthest shelf 12 from the heat exchanger 50. This can result in overcooling the middle shelves in order to achieve the desired cooling at the top and/or bottom shelves 12. Even further still, the travel from the output of the heat exchanger 50 to each of the shelves 12 where the cooling is required causes the temperature of the air provided to the shelves 12 to be higher than the outlet temperature of the heat exchanger 50.

Figure 2:
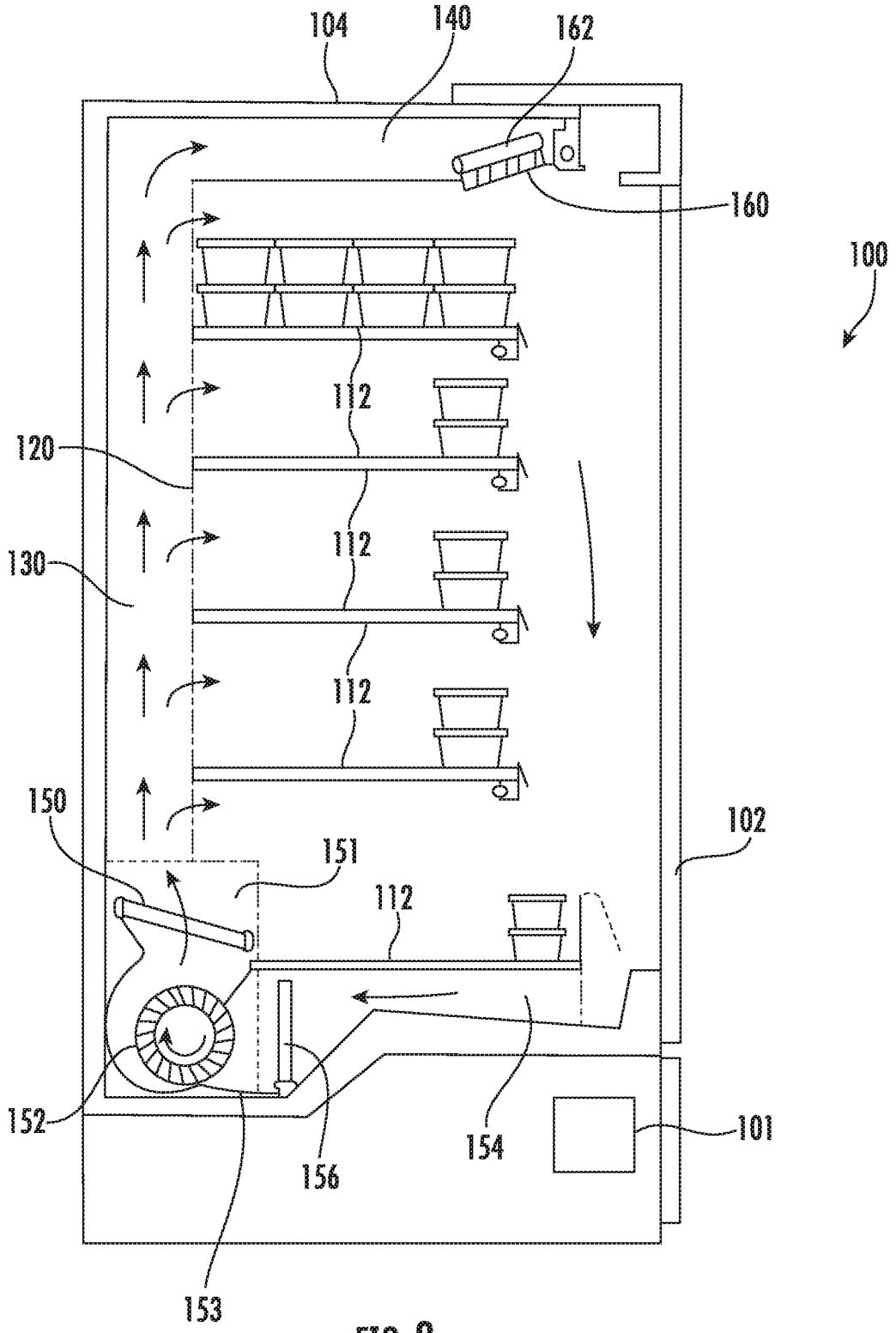
FIG. 2 schematically illustrates an exemplary refrigerated display cabinet including a radial cross-flow fan.

With continued reference to prior art FIG. 1, FIG. 2 schematically illustrates an exemplary refrigerated display cabinet 100 including multiple shelves 112. The shelves 112 provide storage space for one or more temperature sensitive products. A glass door 102 encloses a front portion of a cabinet body 104. As used herein "front" refers to a side of the cabinet facing a user looking through the glass door 102, and relative dimensions such as behind, above, beneath, and the like are provided with the identified front as the frame of reference.

The shelves 112 are supported within the cabinet by a distribution plate 120 positioned at the rear of the shelves 112. An air distribution gap 130 is disposed behind the shelves 112. The air distribution gap 130 transmits air from a primary microchannel heat exchanger 150 to each of the shelves 112. An air return passage 154 is disposed beneath all of the shelves 112, and provides a route for spent air to return from the shelves 112 to the cooling system. A fan 152 is disposed in a fan region 151 of the air return passage 152. The fan 152 is a radial cross flow fan, and drives air through the microchannel heat exchanger 150, and into the air distribution gap 130. As used herein, a radial cross-flow fan refers to a fan that includes a cylindrical bladed rotor mounted for rotation about its axis in a predetermined direction and defining an interior space. The fan includes a guide means defining with the rotor a suction region and a pressure region. The guide means and the rotor co-operate on rotation of the latter in the predetermined direction to induce a flow of fluid from the suction region through the path of the rotating blades on the rotor to the interior space and again through the path of the rotating blades to the pressure region. The guide means and rotor co-operate to set up a vortex having a core region eccentric of the rotor axis and a field region which guides the fluid so that flow through the rotor is strongly curved about the vortex core. Radial cross-flow flow fans can alternatively be referred to as "tangential" or "transverse" fans. Likewise, as used herein, a microchannel heat exchanger refers to a heat exchanger that primarily utilizes flat-tube constructions. A flat tube heat exchanger 102 includes an inlet manifold and an outlet manifold fluidly connected by multiple flat tubes. The flat tubes may be formed to include multiple channels, or internal passageways that are much smaller than the internal passageways of the tubes in the conventional round-tube plate-fin heat exchanger 50.

As used herein, the flat tubes may also include mini size multi-port channels, or micro size multi-port channels (otherwise known as microchannel tubes). The flat tube heat exchangers using small size multi-port channels are alternately known as microchannel heat exchanger 102. In alternative constructions the flat tubes may include one channel, or internal passageway. The microchannel heat exchanger 102 includes a plurality of secondary heat transfer surfaces in the form of serpentine-shape fins with louvers. The fins encompasses the width of the tube which also defines the minor dimension of the microchannel heat exchanger 102 and through which the air flows. The fins are positioned along the flat tubes and solidly coupled to two adjacent flat tubes by a brazing or welding process. While it is appreciated that the cooling air circulates in a loop, as used herein the upstream end of the air return passage 154 is referred to as the beginning of the cycle.

It is appreciated that microchannel heat exchangers, such as the primary microchannel heat exchanger 150 frost at relatively high refrigerant saturation temperatures, and that it is difficult to maintain low enough shelf 112 temperatures when the microchannel heat exchanger has a higher saturation temperature. In order to ameliorate this, a second microchannel heat exchanger 156 (referred to as the pre-cooler microchannel heat exchanger 156) is incorporated upstream of the primary microchannel heat exchanger 150. Additionally the second microchannel heat exchanger allow sufficient time to remove enough heat from the airflow to cool the air to the requisite temperature needed.

In the example of FIG. 2, the pre-cooler microchannel heat exchanger 156 is positioned at the aft end of the air return passage 154, and a cooled air output of the pre-cooler microchannel heat exchanger 156 is provided directly to an input of the radial cross-flow fan 152. Similarly, the primary microchannel heat exchanger 150 is positioned in the fan region 151 immediately downstream of the radial cross-flow fan 152, and provides a cooled air output to the air distribution gap 130.

The pre-cooler microchannel heat exchanger 156 is maintained at high enough saturation temperature that no frost is formed on the pre-cooler microchannel heat exchanger 156, but at a low enough saturation temperature that the pre-cooler microchannel heat exchanger 156 operates as a de-humidifier and extracts moisture from the air prior to providing the air to the radial cross-flow fan 152. The primary microchannel heat exchanger 150 is disposed downstream of the fan 152 and is maintained at a cool enough saturation temperature that the air exiting the primary microchannel heat exchanger 150 is cooled to low enough temperatures to maintain the shelf 112 temperatures below a required cooling threshold.

In order to reduce costs and/or minimize energy expenditures, a controller 101 can be incorporated within the refrigerated display case 100 and can be configured to deactivate (not operate) the pre-cooler 156 during times when there is a low load, such as night time or other times when the door 102 is not frequently opened and closed. During such times, the evaporator function of the pre-cooler microchannel heat exchanger 156 may be unnecessary as the air with the refrigerated display case is a closed system, and new moisture is not introduced until the door 102 is opened.

In order to prevent any moisture that may not have been removed from the air from dripping into the radial cross-flow fan 152 from the primary microchannel heat exchanger 150, the primary microchannel heat exchanger 150 is angled, relative to gravity, and drips into a drip pan 153 upstream of the radial cross-flow fan 152.

Disposed above the top end of the refrigerated case 100 is a top gap 140 connected to the air distribution gap 130. The top gap 140 provides air that has not been distributed to one of the shelves 112 to an air curtain generating fan 160. The air curtain generating fan 160 blows the air downward in front of the shelves 112 to create an air curtain. The air curtain helps prevent outside air from mixing with the cooled air on the shelves 112, as well as draws air through the shelves 112, further increasing the cooling able to be achieved on a given shelf 112.

In the illustrated example of FIG. 2, a third microchannel heat exchanger 162 is disposed immediately upstream of the air curtain generating fan 160, and provides further cooling to the air curtain. In some examples, the fan 160 can be continuously operated, thereby generating a continuous air curtain. In alternative examples, the controller 101 can sense when the door 102 is opened, and the fan 160 can be activated in response to the opening of the door, thereby preventing unnecessary energy usage when the door is closed.

Figure 3:
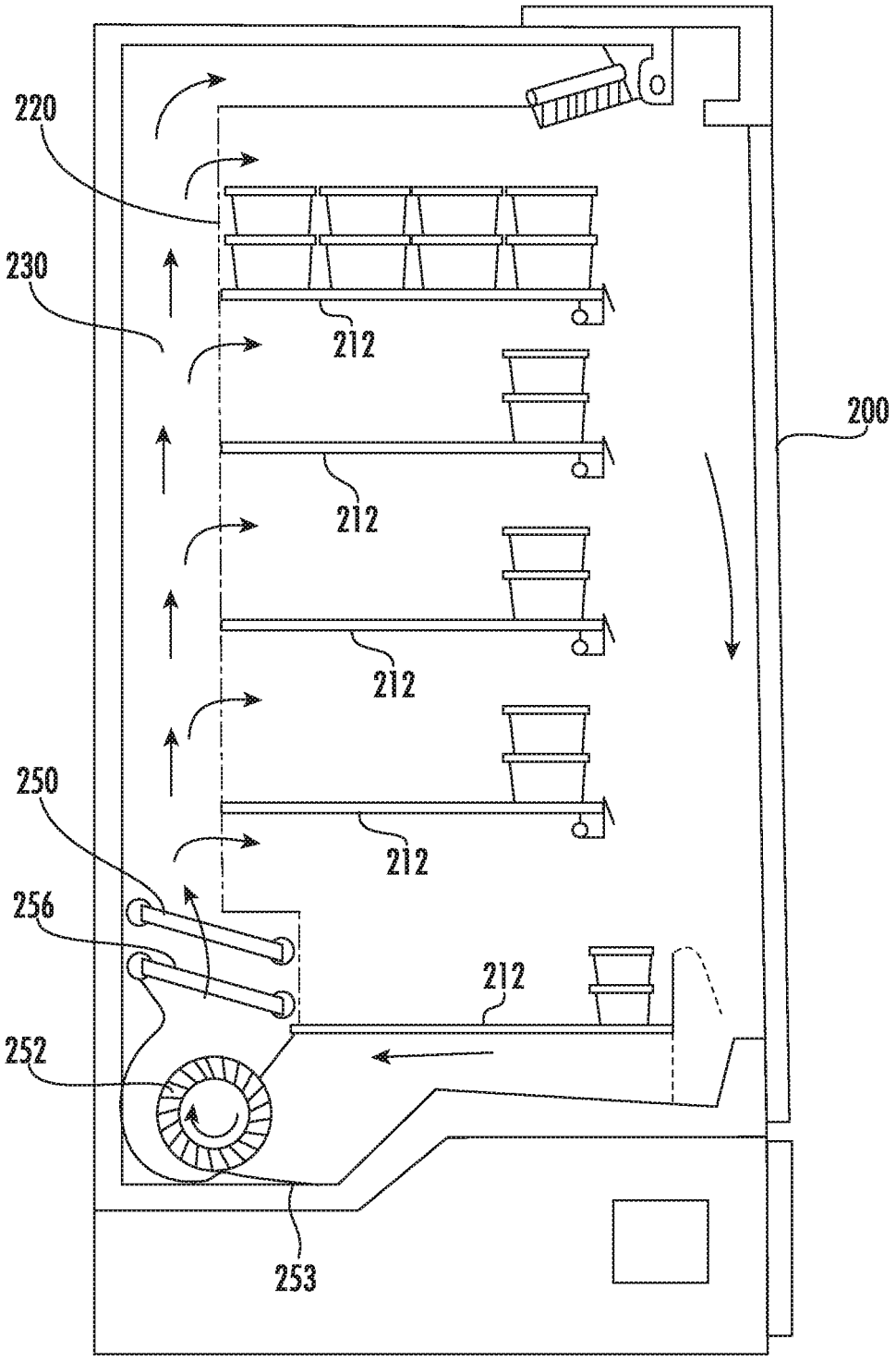
FIG. 3 schematically illustrates a second exemplary refrigerated display cabinet including a radial cross-flow fan.

With continued reference to FIG. 2, FIG. 3 illustrates an alternate example refrigerated display case 200. The alternate example refrigerated display case 200 includes a fundamentally similar cooling circuit, including the air distribution gap 230, distribution plate 220, shelves 212, and top gap 240. In the example of FIG. 3, the pre-cooler microchannel heat exchanger 156 is moved from upstream of the radial cross-flow fan 252 (as in the example of FIG. 2) to immediately downstream of the radial cross-flow fan 252, and between the output of the radial crossflow fan 252 and the input of the primary microchannel heat exchanger 250. As in the example of FIG. 2, the primary microchannel heat exchanger 150 is angled, relative to gravity to allow condensation to pool in a drip pan 253. As the orientation of the pre-cooler heat exchanger 156 is different, the pre-cooler heat exchanger 156 is also angled to allow condensation to avoid the radial cross-flow fan and be removed from the system in the same manner.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A refrigerated display case comprising:

a housing surrounding a plurality of shelves;

an air distribution gap defined behind the plurality of shelves;

an air return passage defined below the plurality of shelves;

a radial cross-flow fan disposed in a fan region of the air return passage, the radial cross-flow fan having an output connected to the air distribution gap;

a primary cooling microchannel heat exchanger disposed in the fan region downstream of the radial cross-flow fan such that air output from the radial cross-flow fan to the air distribution gap passes through the primary cooling microchannel heat exchanger;

a pre-cooler microchannel heat exchanger disposed upstream of the primary cooling microchannel heat exchanger; and the pre-cooler microchannel heat exchanger having a first saturation temperature and the primary cooling microchannel heat exchanger having a second saturation cooling temperature, and where the second saturation temperature is lower than the first saturation temperature.

2. The refrigerated display case of claim 1, wherein the pre-cooler microchannel heat exchanger is disposed downstream of the cross-flow fan.

3. The refrigerated display case of claim 2, wherein the pre-cooler microchannel heat exchanger connects the output of the radial cross-flow fan to the air distribution gap.

4. The refrigerated display case of claim 3, wherein the primary cooling microchannel heat exchanger is disposed immediately downstream of the pre-cooler microchannel heat exchanger.

5. The refrigerated display case of claim 1, wherein the pre-cooler microchannel heat exchanger is disposed upstream of the radial cross-flow fan.

6. The refrigerated display case of claim 5, wherein the pre-cooler microchannel heat exchanger includes a cooled air output connected to an input of the radial cross-flow fan.

7. The refrigerated display case of claim 1, wherein the first saturation temperature is below a temperature required to extract moisture from the return air and above a minimum cooling temperature for the plurality of shelves.

8. The refrigerated display case of claim 7, wherein the second saturation temperature is above a frost temperature.

9. The refrigerated display case of claim 1, further comprising a top duct define above the plurality of shelves and connecting the air distribution gap to an air curtain fan and a third microchannel heat exchanger connected to the air curtain fan such that cooled air is provided to the air curtain fan.

10. The refrigerated display case of claim 1, wherein the fan region is at a downstream end of the air return passage.

11. A method of cooling shelves in a refrigerated display cabinet comprising:

driving air through a cooling circuit using a radial cross-flow fan;

passing the air through a primary microchannel heat exchanger, thereby cooling the air below a minimum cooling temperature of at least one shelf; and extracting moisture from the air using a pre-cooler microchannel heat exchanger prior to passing the air through the primary microchannel heat exchanger; and operating the primary microchannel heat exchanger at a saturation temperature below a frost point and operating the pre-cooler microchannel heat exchanger at a temperature above the frost point and below a condensation point.

12. A method of cooling shelves in a refrigerated display cabinet comprising:

driving air through a cooling circuit using a radial cross-flow fan;

passing the air through a primary microchannel heat exchanger, thereby cooling the air below a minimum cooling temperature of at least one shelf;

extracting moisture from the air using a pre-cooler microchannel heat exchanger prior to passing the air through the primary microchannel heat exchanger; and deactivating the pre-cooler microchannel heat exchanger in response to a controller determining a low load period.

13. The method of claim 12, wherein the pre-cooler microchannel heat exchanger is downstream of the radial cross-flow fan and upstream of the primary microchannel heat exchanger.

14. The method of claim 12, wherein the pre-cooler microchannel heat exchanger is upstream of the radial cross-flow fan.

15. The method of claim 12, further comprising driving at least a portion of the air to create a downward flowing air curtain using an air curtain fan.

16. The method of claim 15, further comprising cooling the at least the portion of the air immediately prior to the air curtain fan using a micro-channel heat exchanger.

17. The method of claim 12, further comprising operating the primary microchannel heat exchanger at a saturation temperature below a frost point and operating the pre-cooler microchannel heat exchanger at a temperature above the frost point and below a condensation point.

18. The method of claim 12, further comprising reactivating the pre-cooler microchannel heat exchanger in response to a controller detecting a door opening.

19. A refrigerated display case comprising:

a housing surrounding a plurality of shelves;

an air distribution gap defined behind the plurality of shelves;

an air return passage defined below the plurality of shelves;

a radial cross-flow fan disposed in a fan region of the air return passage, the radial cross-flow fan having an output connected to the air distribution gap;

a primary cooling microchannel heat exchanger disposed in the fan region downstream of the radial cross-flow fan such that air output from the radial cross-flow fan to the air distribution gap passes through the primary cooling microchannel heat exchanger;

a pre-cooler microchannel heat exchanger disposed upstream of the primary cooling microchannel heat exchanger; and a controller configured to deactivate the pre-cooler microchannel heat exchanger during a low load period.

* * * * *